US006443753B1

(12) United States Patent
Bludis et al.

(10) Patent No.: US 6,443,753 B1
(45) Date of Patent: Sep. 3, 2002

(54) POWER TOOL CORD RETAINER

(75) Inventors: Thomas Trevor Bludis, Cockeysville, MD (US); Richard J. Heavel, Hanover, PA (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 09/873,658

(22) Filed: Jun. 4, 2001

(51) Int. Cl.[7] ..... H01R 13/62
(52) U.S. Cl. ..... 439/373; 439/484
(58) Field of Search ..... 439/367, 369, 439/484, 370, 373, 501

(56) References Cited

U.S. PATENT DOCUMENTS

| | | | | |
|---|---|---|---|---|
| 2,089,665 | A | 8/1937 | Roberts et al. | |
| 4,875,879 | A | 10/1989 | Bunyea et al. | |
| 5,318,158 | A | 6/1994 | Seasholtz | |
| 5,330,138 | A | 7/1994 | Schlessmann | |
| 5,454,729 | A | 10/1995 | Wen-Te | |
| 5,472,355 | A | 12/1995 | Wittmann | |
| 5,573,422 | A | 11/1996 | Lawliss | |
| 5,581,891 | A | * 12/1996 | Wheeler | 30/216 |
| 5,620,336 | A | 4/1997 | Worthing | |
| 5,713,758 | A | 2/1998 | Goodin et al. | |
| 5,957,721 | A | 9/1999 | Searle et al. | |
| 6,012,940 | A | 1/2000 | Wheeler | |
| 6,058,612 | A | 5/2000 | Leyva | |
| 6,135,803 | A | 10/2000 | Kovacik et al. | |

* cited by examiner

*Primary Examiner*—Khiem Nguyen
(74) *Attorney, Agent, or Firm*—Harness, Dickey & Pierce, P.L.C.

(57) ABSTRACT

A power cord retaining device for a portable AC powered tool. A retaining member holds the power cord plug engaged with a mating AC power jack in the housing of the power tool. The retaining member moves within the housing of the power tool from an unlocked position to a locked position. In one embodiment the retaining member slides within the housing of the power tool. In an alternative embodiment the retaining member rotates within the housing of the power tool. In the locked position the power cord plug is held in place engaged with the mating power jack in. the housing of the power tool. In one embodiment a release member having a biasing element locks the retaining member in place until it is manually unlocked by the user thereby permitting the retaining member to be moved away from the power jack to permit removal of the plug from the power jack. Another alternative embodiment incorporates a retaining member which is biased into engagement with a release housing portion of the power tool housing.

12 Claims, 6 Drawing Sheets

FIG. 1.
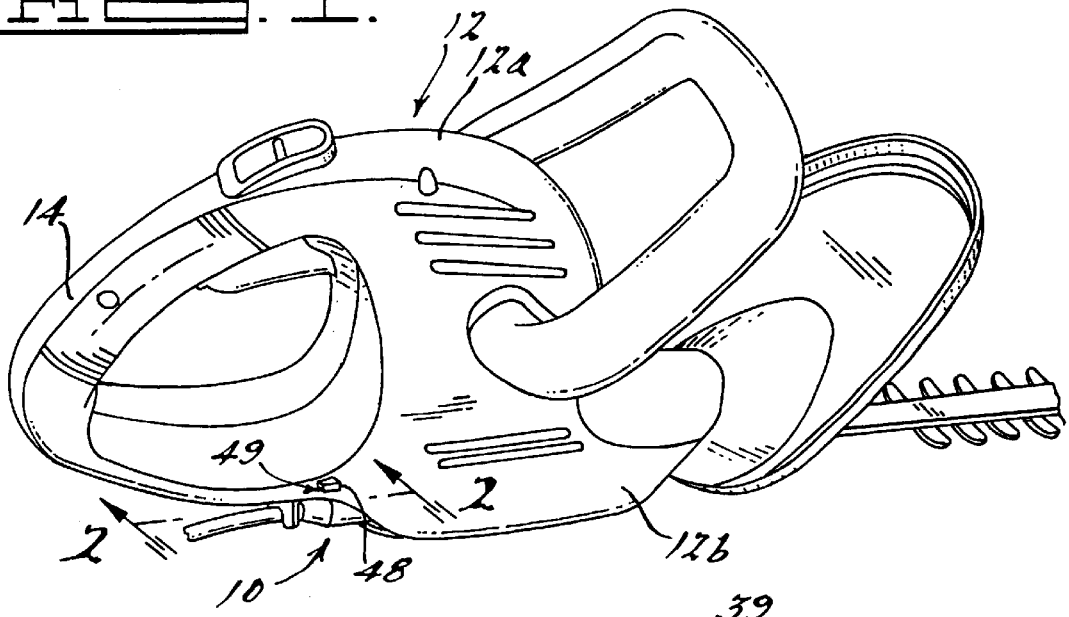
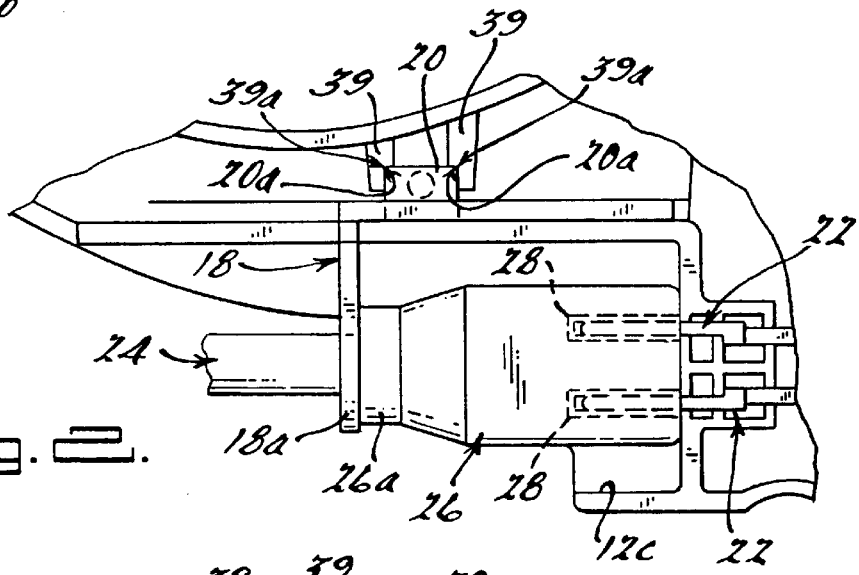
FIG. 2.
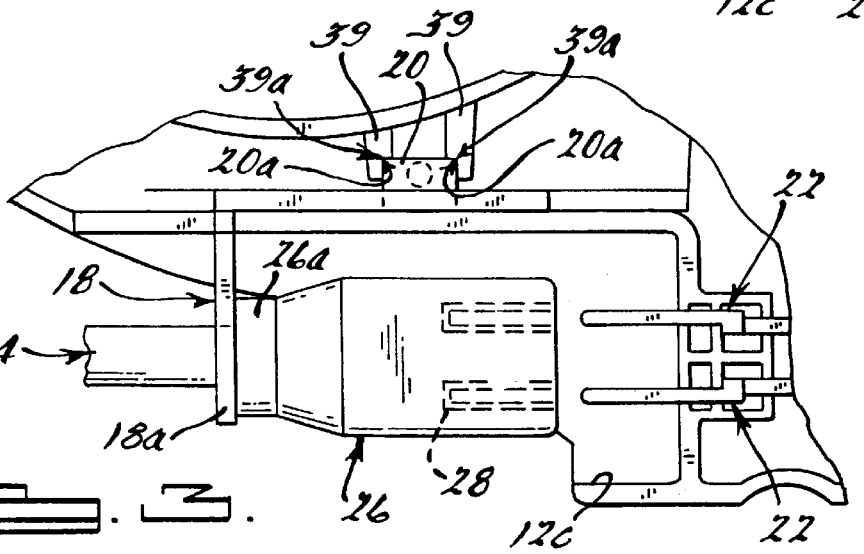
FIG. 3.

POWER TOOL CORD RETAINER

FIELD OF THE INVENTION

The present invention relates generally to power cord retention devices and more particularly to a power cord retention device for a portable AC powered tool.

BACKGROUND OF THE INVENTION

Many power tools require an extension power cord to connect the power tool to an AC power source. Portable AC powered tools such as hedge trimmers or string trimmers typically have male electrical contact blades in the housing of the power tool that connect to a female electrical receptacle plug at the end of an extension power cord. A common problem with portable AC powered tools is how to secure the extension power cord to the power tool in such a manner that it will not easily pull free during operation of the power tool. This is complicated by variations in the design of power cords that make one solution for securing a power cord not necessarily practical for all power cords. Further, some power tools are often operated in a way that strains the connection between the power cord and the AC power jack of the power tool. For example, an operator can carry a hedge trimmer with the extension power cord in tow thus causing an intermittent tugging or strain to the power cord connection. As a result of both the constant vibration of the tool together with the intermittent movement of the operator, the power cord can easily pull free of the tool's AC power jack.

Therefore, there is a need for a power cord retaining device that will operate with a variety of extension power cords and which will even more securely hold the extension cord to the power tool in spite of movement and vibration that is common in the operation of the power tool.

SUMMARY OF THE INVENTION

It is an object of the invention to provide a system for more securely holding a female plug of an extension power cord to a portable AC power tool. It is a further object to provide a system that is easily used by an operator, and which securely holds the power cord secured to the tool's AC power jack in spite of vibration and movement of the power tool during use thereof. An additional object is to provide a cord retaining system that will work with a variety of extension power cord types including a variety of differently shaped plugs. Another object of the invention is to provide a system that is easy to use and understand by its operator and which does not require the use of external tools or fasteners to secure the plug head of an extension power cord to an AC power jack of a power tool.

The present invention is directed to a cord retaining system associated with a housing of a portable power tool. The system provides a secure connection that can be quickly and easily effected between the power tool and the power cord so that the power cord cannot be accidentally pulled free from engagement with a power jack of the tool during use of the power tool.

In operation, the female plug at one end of the power cord is secured to the body or housing of the power tool by-a retaining member that pulls the plug towards the body or housing of the power tool once the plug is engaged in a mating AC power jack disposed in the housing. In one preferred form, the retaining member comprises a linearly moveable yoke adapted to engage a plug of an AC power cord. A release member engages a portion of the yoke to hold the yoke in a locking position once the yoke has secured a plug of the power cord to the power jack. The retaining yoke holds the plug securely to the power tool by a locking system that can be easily disengaged by the power tool operator when it is necessary to uncouple the power cord from the tool. Advantageously, neither engagement of the yoke to the plug head or disengagement therefrom requires the use of any external tool(s) by the operator.

The retaining system incorporates locking components with opposing surfaces that when engaged prevent movement of the yoke in one longitudinal or rotational direction. In one preferred form the yoke includes one serrated surface, and the release member, disposed in proximity to the yoke, includes a mating serrated surface. The serrated surfaces are angled such that movement in one direction is allowed while attempted movement in the opposite direction causes the teeth of the serrated surfaces to engage and prevent movement. A biasing component is used to hold the opposing serrated surfaces together, therefore allowing movement of the yoke only in the locking direction. By actuating the release member the serrated surfaces are forced apart, thus allowing the retaining yoke to move in an unlocking direction to a position allowing the operator to free the power cord from the retaining yoke and the power cord jack.

In one preferred embodiment the retaining yoke slides longitudinally within a housing of the power tool, and the yoke includes a serrated surface on a side edge thereof. A spring forces the opposing surface edge of the release member against the serrated edge of the yoke.

In a second preferred embodiment the retaining yoke slides longitudinally within the housing of the power tool and the retaining system includes a serrated surface on a top planar surface of the retaining yoke. The retaining yoke opposes a serrated surface on the release member, and a portion of the release member protrudes through a portion of the housing. The release member comprises a flexible member having a curved form. The curved form of the mechanism allows a biasing force to be exerted against the opposing serrated surface of the retaining yoke, thus preventing the yoke from moving in an unlocking direction unless the release member is engaged by the operator so as to lift it away from the serrated surface on the retaining yoke.

In a third preferred embodiment the retaining yoke rotationally moves within the housing of the power tool and comprises a rotationally moveable yoke adapted to engage a plug of the AC power cord. The retaining member has a central hub about which the retaining member moves. The central hub has a circumferentially arranged serrated surface that engages a corresponding serrated surface on a release housing portion disposed in the housing of the power tool. A compression spring in the housing portion of the cord retaining system and the hub continuously urges the serrated surface of the retaining member against the serrated surface of the release housing portion. In a locked position the retaining member engages a plug head of a power cord to retain the plug head engaged with an AC power jack in the tool housing.

To release the retaining member, a button that is attached to the hub of the retaining member is depressed. This urges the serrated surface of the retaining member away from the serrated surface on the inside of the release housing portion. The retaining member can be rotated away from the AC power jack to allow the power cord plug head to be easily removed. The orientation of the serrated surfaces allows the retaining member to only be moved toward the AC power jack if the button is not being engaged. It is only when the button is engaged that the retaining member can be rotated away from the AC power jack.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 1 is a perspective view of a hedge trimmer as an exemplary portable power tool with the power cord retaining system of the present invention incorporated into its housing;

FIG. 2 is a cross sectional side view of a portion of the power tool housing of FIG. 1, taken in accordance with section line 2—2 in FIG. 1, depicting the power cord retaining system in the locked position holding a power cord receptacle to a mating electrical power jack of the power tool;

FIG. 3 is a cross section of the power tool housing of FIG. 1 depicting the power cord retaining system in the unlocked position with a plug head of a power cord pulled back from the mating electrical receptacle in the housing;

DETAILED DESCRIPTION OF THE PREFERRED EMBODIMENTS

Figure 4:
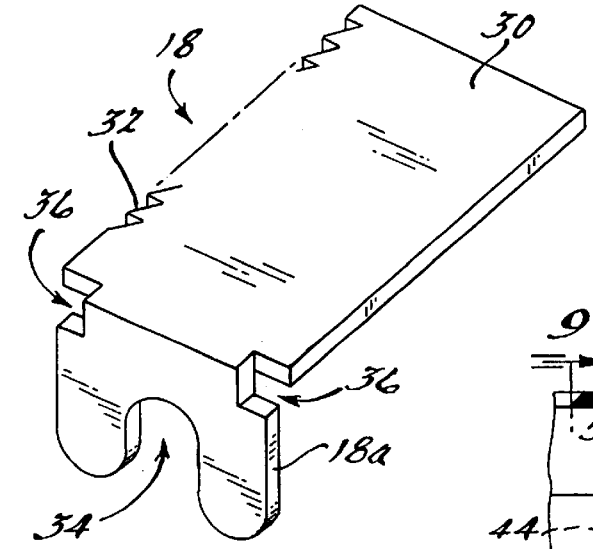
FIG. 4 is a perspective view of the power cord retaining member.

The following description of the preferred embodiment(s) is merely exemplary in nature and is in no way intended to limit the invention, its application, or uses.

In FIG. 1 an AC powered portable tool 12 incorporating a power cord retaining system 10 in accordance with a preferred embodiment of the present invention is shown. It will be appreciated immediately that while the power tool 12 is illustrated as a hedge trimmer, that the invention can be used with virtually any portable AC power tool, and therefore should not be construed as being limited to use with only hedge trimmers.

A housing 12*a* of the power tool 12 includes a handle 14 and a lower portion 12*b* at which the power cord retaining system 10 is located.

Referring to FIG. 2, the power cord retaining system 10 includes an L-shaped retaining member 18 having a yoke 18*a* and a release member 20. The system 10 is disposed in close proximity to a male AC power jack 22 which is disposed in a cavity 12*c* in the housing 12*a*, as is conventional with many portable AC power tools.

A power cord 24 has a female receptacle plug head 26 having female electrical receptacles 28 that engage the male AC power jack contact blades 22 disposed in the housing 12*a* of the power tool 12. The yoke 18*a* of the retaining member 18 holds the plug head 26 engaged with the AC power jack 22 by contact with a shoulder portion 26*a* of the plug head. FIG. 3 illustrates the power cord retaining system 10 in the unlocked (or open) position wherein the retaining member 18 is pulled away from the power jack 22, thus allowing the plug head 26 to be removed from the yoke 18*a*.

FIG. 4 illustrates the retaining member 18 in greater detail. The retaining member 18 has a planar, rectangular surface 30 extending perpendicularly to the yoke component 18*a*. The rectangular surface 30 also has a serrated edge 32. The yoke component 18*a* has an opening 34 large enough for the power cord 24 to fit through but small enough to prevent the plug head 26 at the end of the power cord from pulling through the yoke component.

Figure 8:
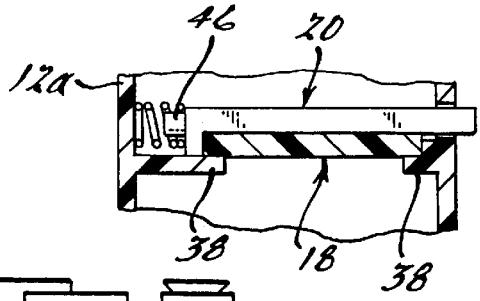
FIG. 8 is a partial cross sectional end view of the power cord retaining member and release member taken in accordance with section line 8—8 in FIG. 6 with the release member in the engaged position.
Figure 9:
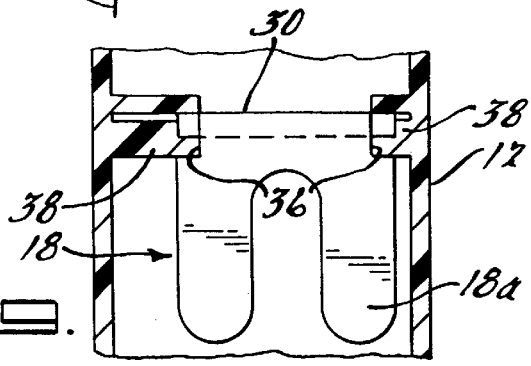
FIG. 9 is a partial cross sectional end view of the power cord retaining member taken in accordance with section line 9—9 in FIG. 6 illustrating the retaining yoke supported by opposing flanges within the housing.

The yoke component 18*a* has notches 36 that allow the rectangular surface 30 to slide in linearly extending, opposing flanges or tracks within the housing 12*a*. Referring briefly to FIGS. 8 and 9, a pair of such tracks 38 are illustrated. Tracks 38 are formed so as to project from opposing interior surfaces of the housing 12, which is typically formed with a mating, two-piece construction, to facilitate assembly of the tool 12. The tracks 38 engage the edges of the rectangular surface 30 of the retaining member 18 for sliding movement thereon.

Figure 5:
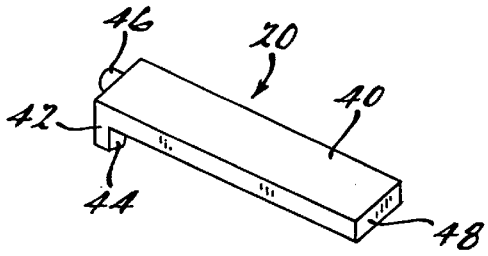
FIG. 5 is a perspective view of the release button for the power cord retaining system.
Figure 6:
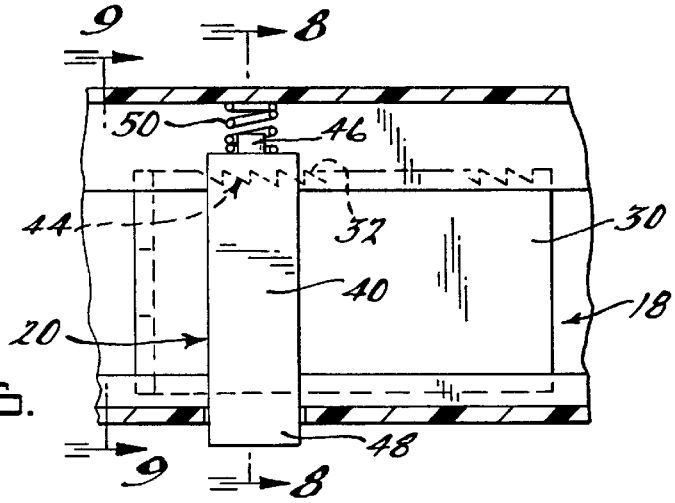
FIG. 6 is a cross sectional top view of the power tool housing of FIG. 1 depicting just the power cord retaining member with the release member engaging the retaining member.
Figure 7:
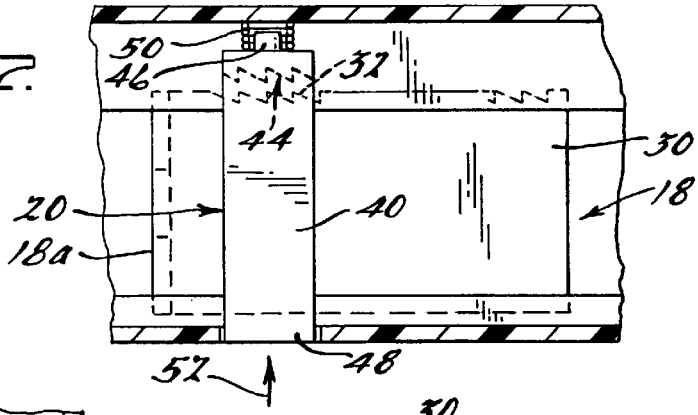
FIG. 7 is a cross sectional top view of the power tool housing of FIG. 1 depicting the power cord retaining member with the release member disengaged from the retaining member.

FIG. 5 illustrates the release member 20 of the power cord retaining system 10 in greater detail. The release member 20 has a rectangular surface component 40 and a perpendicularly extending locking arm 42. The locking arm 42 has a serrated surface 44, as also shown in FIGS. 6 and 7 by hidden lines. The release member 20 also has a boss portion 46 for holding a biasing device such as a coil spring. The opposite end of the release member 20 forms a release button 48 which allows the release member to be depressed inwardly thus disengaging the release member 20 from the retaining member 18. As shown in FIG. 1, button 48 protrudes slightly from an opening 49 in the housing 12*b* to allow easy engagement thereof by a user when the power cord 24 is to be released from the tool 12.

With brief reference to FIGS. 2 and 3, a pair of opposing ribs 39 are formed on an interior surface of the housing 12*a*. Each of the ribs 39 includes a notch 39*a* adapted to engage a corner of the rectangular portion 20*a* of the release member 20. The ribs 39 serve to guide the release member 20 for sliding movement perpendicularly to the retaining member 18.

FIGS. 6 and 7 illustrate top views of the system 10 showing the retaining member 18 with the release member 20 resting on top of the retaining member. A coil spring 50 is used to bias the release member 20 into constant contact with retaining member 18 such that the serrated surfaces 32 and 44 intergage one another. FIG. 6 shows the system 10 in the locked position. In this position the retaining member 18 is prevented from moving in the direction away from the power jack 22 (i.e., to the left) in the housing 12*a* of the power tool 12. The serrated edge 32 of the retaining member 18 is held against the serrated surface 44 of the release member 20 by the spring 50. The spring 50 is held in place against the release member 18 by the boss portion 46.

Referring briefly to FIGS. 8 and 9, the release member 20 rests on top of the retaining member 18. FIG. 8 shows the system 10 in the locked position with the serrated surface 44 engaging the serrated edge 32.

FIG. 7 shows the system 10 in the unlocked position. The serrated edge 32 of the retaining member 18 is shown separated from the serrated surface of the release member 20 as a result of a force applied to the button 48 along directional line 52. This moves the serrated surface 44 of the release member 20 out of engagement with the serrated edge 32 of the retaining member 18, which allows the retaining member 18 to be moved slidably away from the power jack 22 in the housing 12*a* of the power tool 12 while the button 48 is held depressed. The spring 50 is shown in the compressed position in FIG. 7 when the release button 48 is depressed in order to unlock the system 10.

Figure 10:
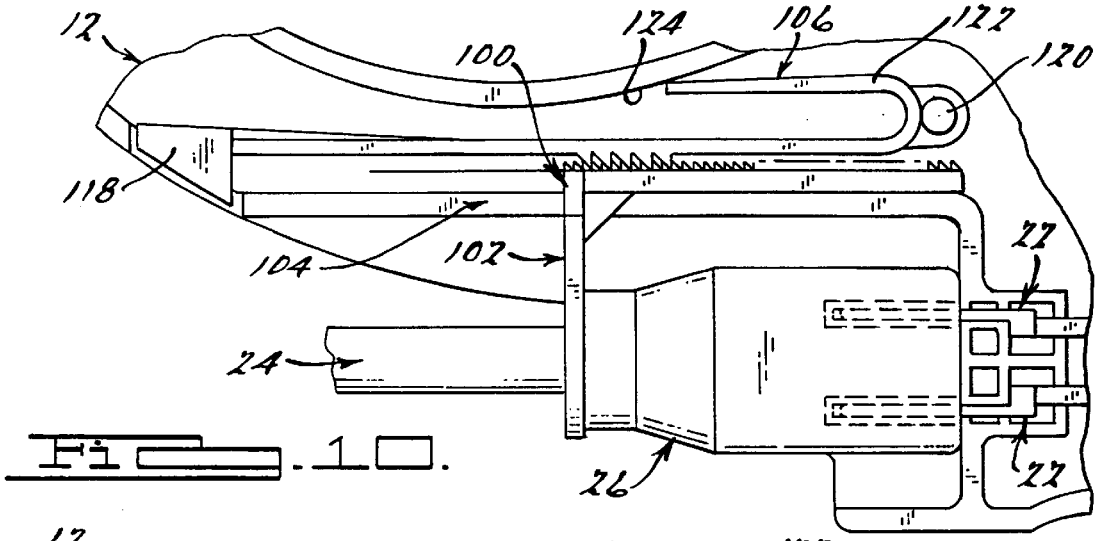
FIG. 10 is a cross section of a portion of the power tool housing depicting a second alternative preferred embodiment of the power cord retaining system in the locked position holding a power cord receptacle.
Figure 11:
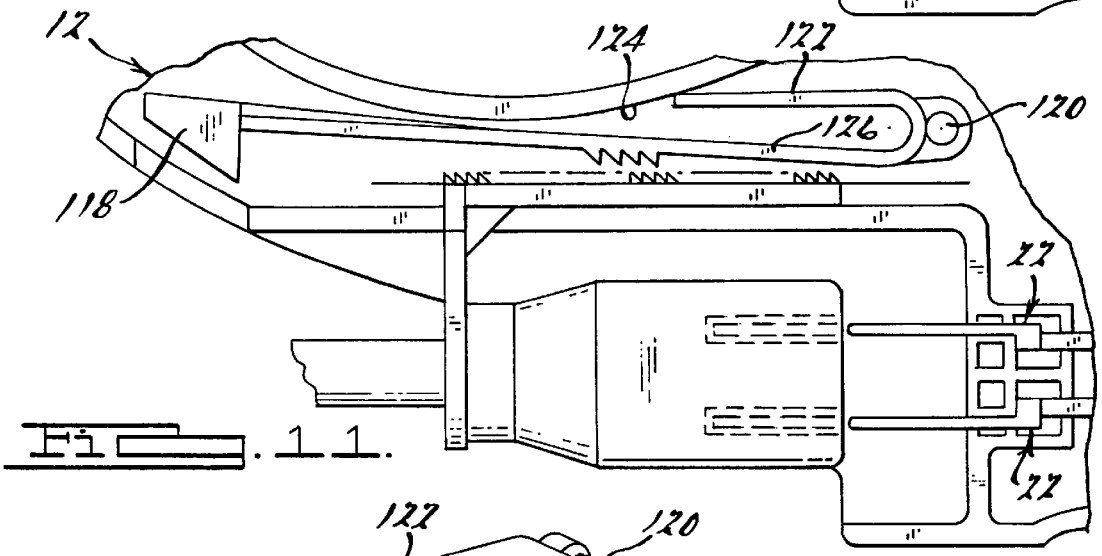
FIG. 11 shows the power tool of FIG. 10 but with the retaining system in the unlocked position.

FIGS. 10 and 11 illustrate a cord retaining system 100 in accordance with a second alternative preferred embodiment of the present invention. A retaining member 102 holds the power cord female plug head 26 engaged with the AC power jack contact blades 22 in the power tool 12. The retaining member 102 slides in a track 104 of the housing 12*a*. The retaining member 102 has a serrated top surface 116.

Figure 12:
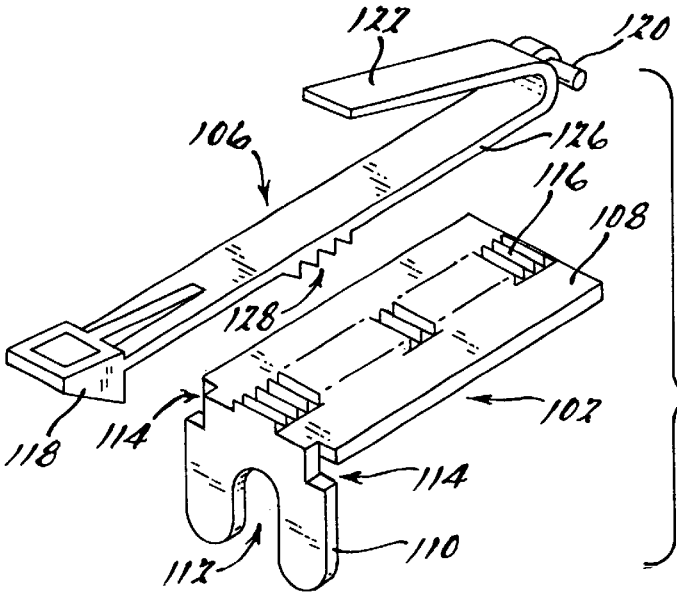
FIG. 12 is an exploded perspective view of the power cord retaining member and release member of the embodiment of FIGS. 10 and 11.

FIG. 12 illustrates a release member 106 in spaced apart relation to the retaining member 102. The retaining member 102 has a rectangular planar surface 108 and a perpendicularly extending yoke component 110. The yoke component 110 has an opening 112 large enough for the power cord 24 to fit through but small enough to prevent the plug head 26 from pulling through the yoke 110. The yoke 110 has notches 114 that allow the retaining component to slide on the tracks 38 (FIG. 9) of the power tool housing 12*a*. The retaining member 102 has a serrated surface 116 formed on the planar surface 108 thereof, rather than on an edge, as with the system 10 of the first described embodiment.

With reference to FIGS. 11 and 12, the release member 106 has a release element 118 formed at one end and a pair of mounting members 120 at the other end. An upper portion 122 of the release member 106 in contact with wall portion 124 allows a lower portion 126 thereof to be continuously urged into engagement with the retaining member 102. Release member 106 is made from plastic and has a degree of flexibility which allows the lower portion 126 to be biased into constant contact with the retaining member 102 when the tool 12 is assembled. The mounting members 120 support the release member 106 from suitable recesses (not shown) in the power tool housing 12*a*.

The release member 106 has a serrated surface 128 that engages the serrated surface 116 of the retaining member 102. When the release element 118 is depressed, as indicated in FIG. 11, it pushes the serrated surface 128 of the release member 106 away from the serrated surface 116 of the retaining member 102. While it is held in this position, the retaining member 102 can be moved slidably away from the power jack 22.

Figure 13:
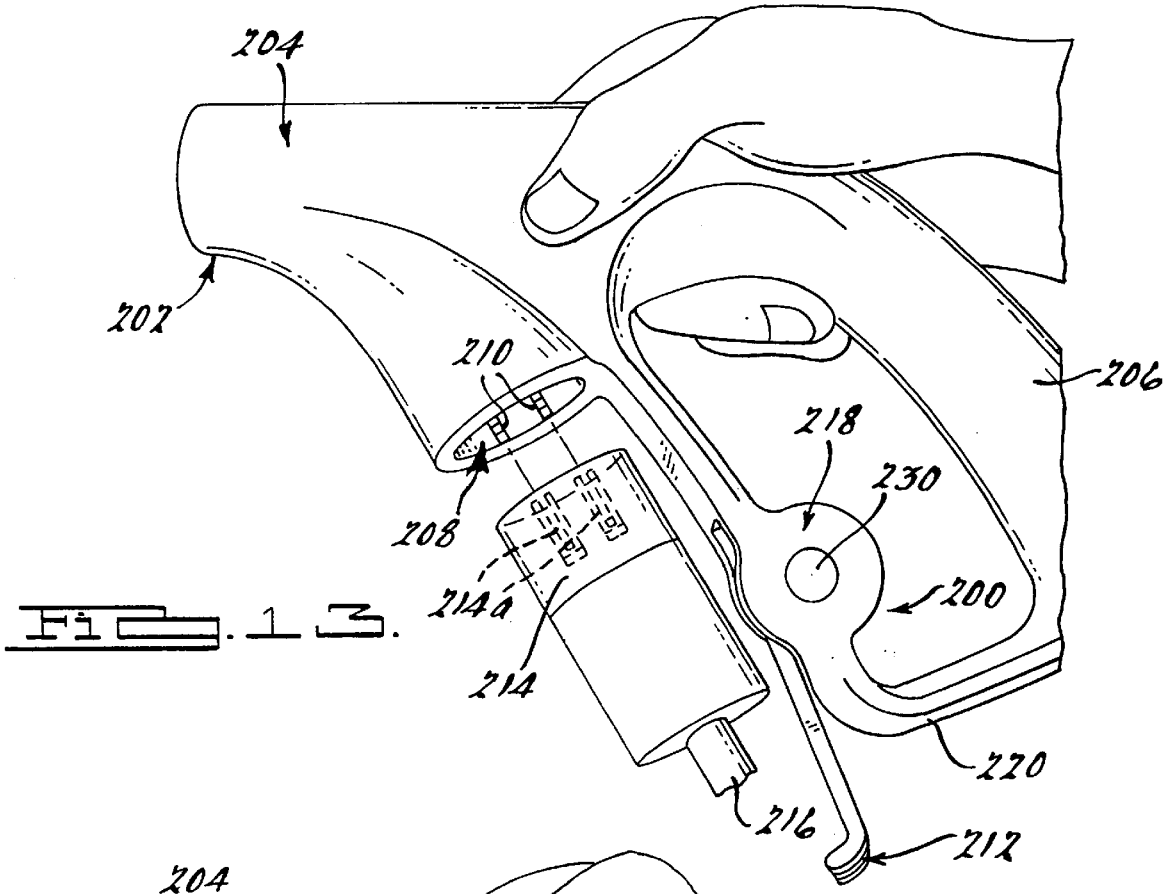
FIG. 13 is a perspective view of an exemplary portable power tool depicting a third alternative preferred embodiment of the power cord retaining system incorporated into a housing of a power tool, with the retaining system shown in the open position.
Figure 14:
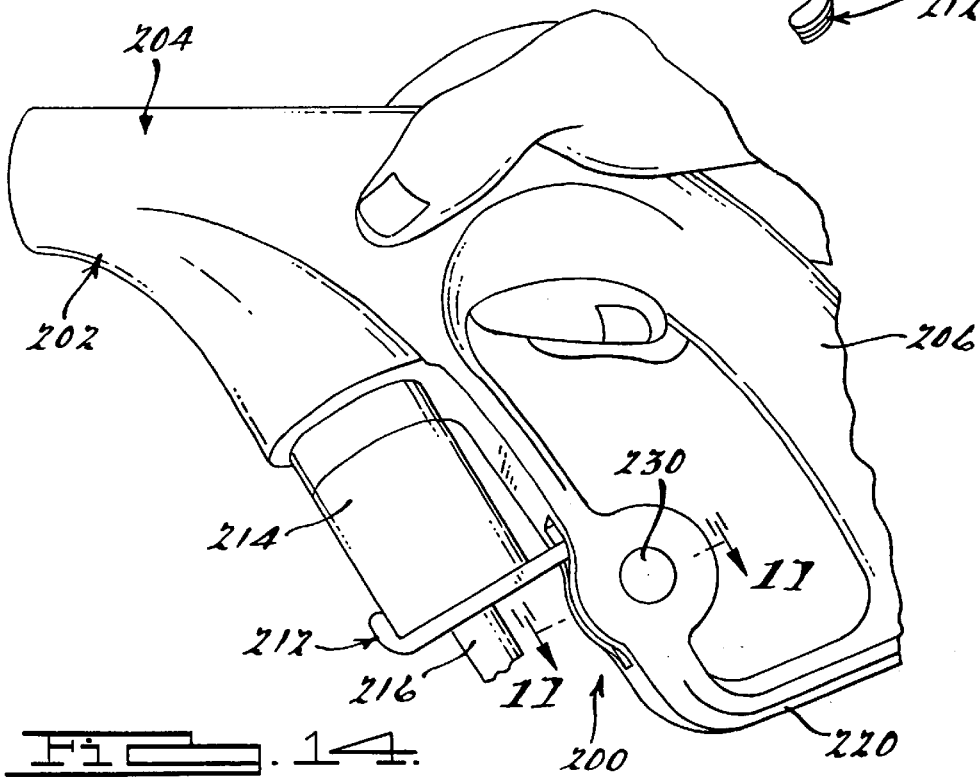
FIG. 14 is a perspective view of the portable power tool of FIG. 13 with a retaining member of the power cord retaining system in the closed position, thus retaining a power cord plug to the AC power jack of the tool housing.

FIGS. 13 and 14 illustrate a cord retaining system 200 in accordance with a third alternative preferred embodiment of the present invention. The cord retaining system 200 is shown in connection with an electric power tool 202 having a housing 204 which includes a handle portion 206. An AC power jack 208 having a pair of contact blades 210 is formed in the housing 204.

The retaining system 200 includes a retaining member 212 which is adapted to hold the internal contacts 214*a* of a female plug head 214 of an AC power cord 216 securely to the power jack 208. The retaining member 212 is pivotally supported from a portion of the retaining member housing portion 218 of the system 200. The cord retaining housing portion 218 is formed as part of a loop handle portion 220 of the handle 206. Thus, the retaining member 212 can be moved pivotally from the open position illustrated in FIG. 13 to the closed position illustrated in FIG. 14.

Figure 15:
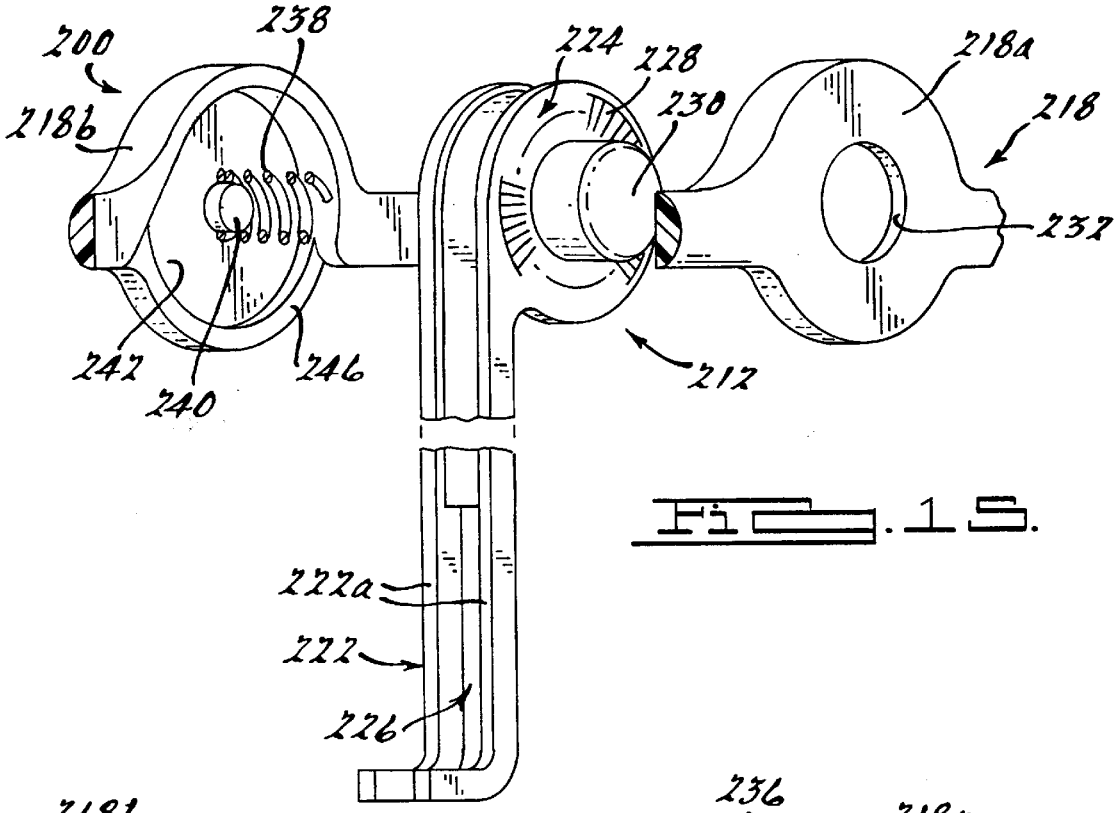
FIG. 15 is an exploded perspective front view of the power cord retaining system of FIGS. 13 and 14.

Referring to FIG. 15, the cord retaining system 200 can be seen to include housing members 218*a* and 218*b* which form the housing portion 218 when assembled together. The retaining member 212 includes an L-shaped lower yoke component 222 and a circular locking component 224. The yoke component 222 has a pair of arms 222*a* which form an opening 226 therebetween large enough to accommodate the power cord 216 but small enough to prevent the plug head 214 from pulling therethrough. The retaining member 212 further has a radial serrated surface 228 formed on one side of the circular locking component 224. A release button 230 is also formed on the retaining member 212 and disposed at the axial center of the circular locking component 224.

Figure 16:
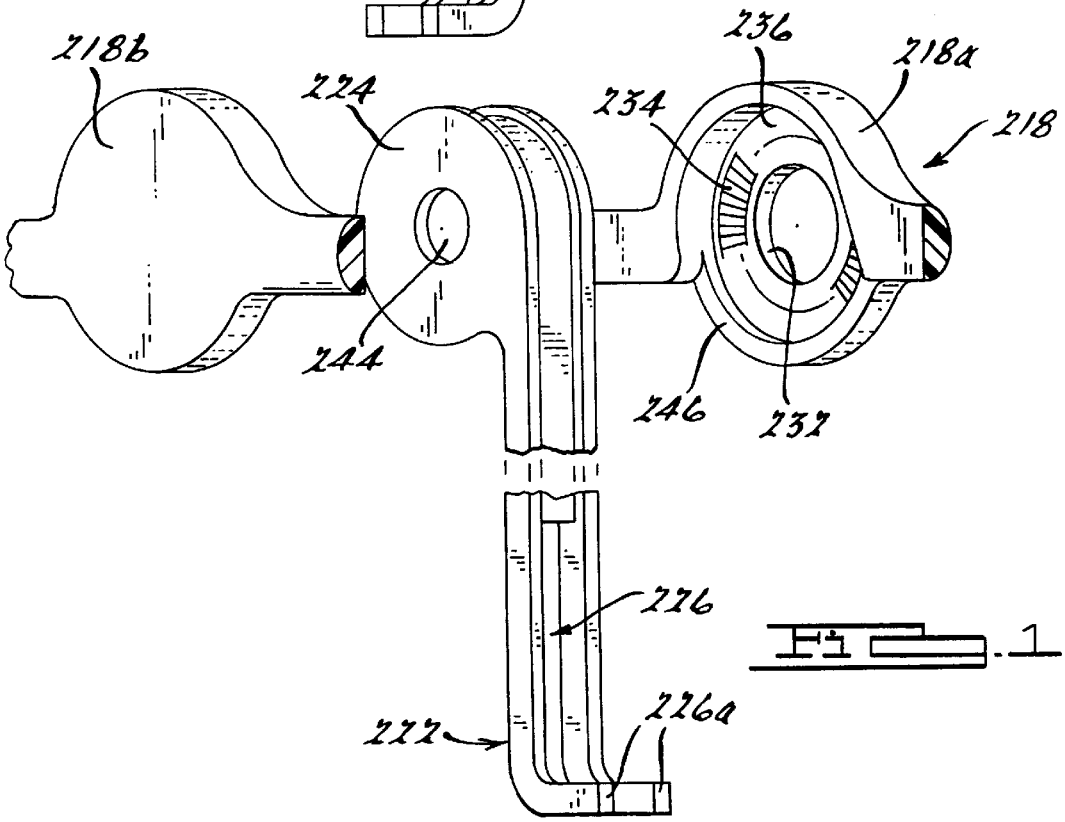
FIG. 16 is an exploded perspective back view of the power cord retaining system of FIGS. 13 and 14.
Figure 19:
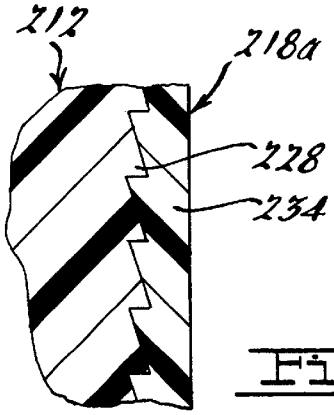
FIG. 19 is a cross sectional view of the power cord retaining system of FIGS. 13 and 14, taken in accordance with section line 19—19 in FIG. 17, depicting the serrated surface of the retaining member engaged with the serrated surface of one of the housing members.

With further reference to FIGS. 15 and 16, housing member 218*a* has an opening 232 for allowing the release button 230 to project from the housing member 218*a*. In FIG. 16, it can be seen that the housing member 218*a* also includes a radial serrated or toothed surface 234 formed on an inner surface 236 thereof. When assembled, the serrated surface 234 is in facing relationship with, and normally engaged with, the serrated surface 228 on the circular locking component 224 of the retaining member 212. With brief reference to FIG. 19, the serrated surfaces 228 and 234 are each formed with a sawtooth like shape which allows ratcheting movement of the retaining member 212 in only one direction (clockwise in FIGS. 13 and 14) when the serrated surfaces 228 and 234 are engaged.

With further reference to FIGS. 15 and 16, the housing member 218*b* of the retaining system 200 has a spring 238 which has one end thereof held at the axial center of the member 218*b* by a boss portion 240 protruding from an inside surface 242 of the member 218*b*. The opposite end of the spring 238 rests within a recess 244 formed at the axial center of the circular locking component 224 on the side opposite to the release button 230. When the retaining system 200 is assembled, the spring 238 biases the serrated surface 228 of the retaining member 212 against the serrated surface 234 (FIG. 16) of the housing member 218*a*, thus maintaining the release button 230 in a position protruding from opening 232.

Figure 17:
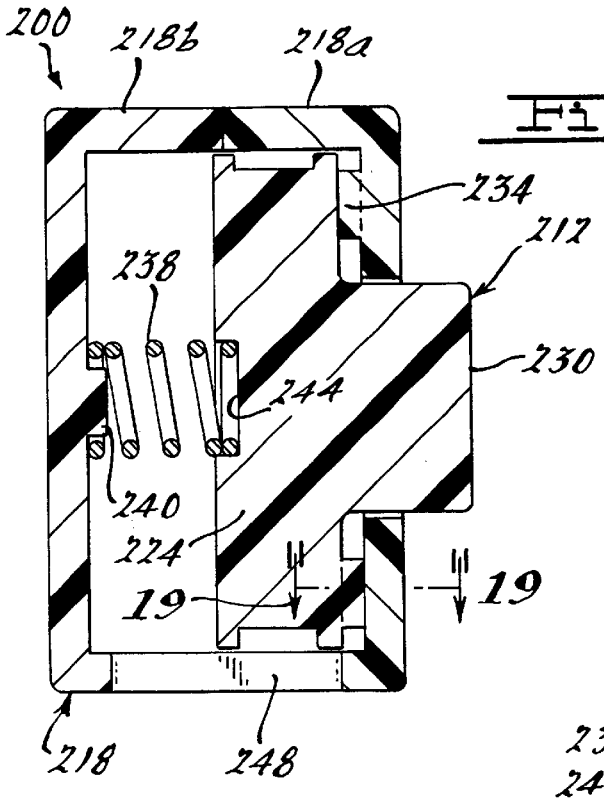
FIG. 17 is a cross sectional view of a portion of the power tool housing of FIG. 14, taken in accordance with section line 17—17 in FIG. 14, depicting the power cord retaining system with the retaining member engaged with the serrated surface of the housing member.

With reference to FIGS. 15–17, depressed walls 246 (FIGS. 15 and 16) are formed in each of the housing members 218*a* and 218*b* to cooperatively form an arcuate slot 248 (FIG. 17) when the housing members are assembled. The arcuate slot 248 permits the yoke component 222 of the retaining member 212 to extend from the housing members when the members are assembled together. FIG. 17 illustrates the serrated surface 228 of the circular locking component 224 biased into engagement with the serrated surface 234 of housing component 218*a* and maintaining the release button 230 projecting through the opening 232.

Figure 18:
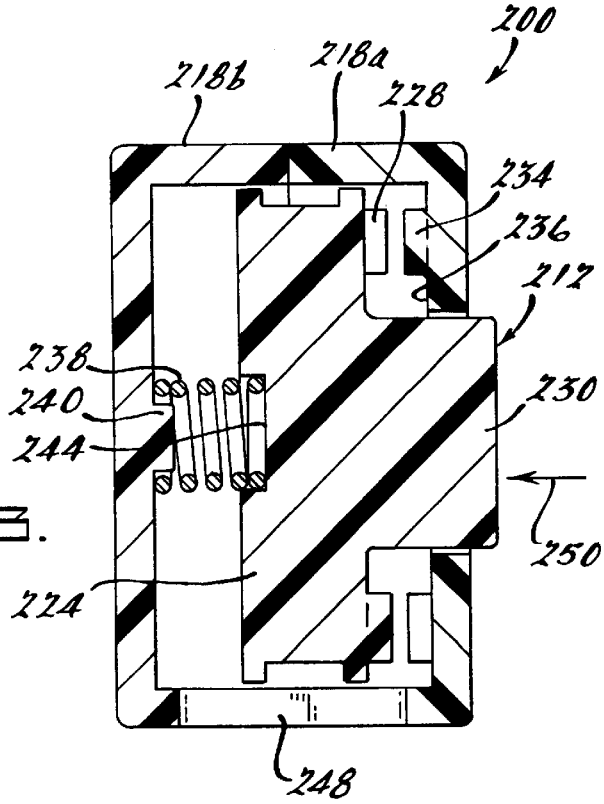
FIG. 18 is a cross sectional view of the power cord retaining system of FIGS. 13 and 14, with the retaining member disengaged from the serrated surface of the housing member.

Referring to FIG. 18, the retaining member 212 is disengaged from the serrated surface 234 of housing member 218*a* when a force is applied against the release button 230, as indicated by directional arrow 250. While such a force is being applied, the retaining member 212 can be rotated from its closed position, shown in FIG. 14, to its open position shown in FIG. 13. When moved into its open position, the power cord 216 can be removed from the yoke component 222 of the retaining member 212. Attachment of the power cord 216 to the AC power jack 208 is accomplished by plugging the plug head 214 into the AC power jack 208 while the retaining member 212 is in its open position (FIG. 13). The power cord 216 is then threaded between the arms 222*a* of the yoke component 222 and the retaining member 212 is then moved into its closed position (FIG. 14). Once in the closed position, the retaining member 212 cannot move toward the open position unless the release button 230 is depressed.

The preferred embodiments described herein provide an easy to use means for holding an electrical power cord secured to an AC power jack of a portable, AC powered tool. Advantageously, the embodiments do not require any external tools or cumbersome procedures for securing or releasing the power cord to and from an AC power jack. Furthermore, the preferred embodiments do not significantly add to the complexity of manufacture of the tool or increase significantly its cost, weight or overall dimensions. In addition, the preferred embodiments accommodate a variety of plug head shapes and sizes.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A cord retainer for retaining a power cord to a power jack disposed in a housing of a power tool comprising:

a retaining member for engaging a portion of said power cord wherein said retaining member is supported by said housing and moves rotationally between a first position, wherein said power cord can be readily released from said retaining member, and a second position wherein a portion of said retaining member holds said power cord engaged to said power jack in the housing, and the retaining member cannot be moved back into said first position without operator intervention; and a release housing portion of said housing operably associated with the retaining member for preventing rotational movement of said retaining member toward said first position said retaining member being moveable away from a surface of said release housing portion to thereby manually unlock said retaining member, to thereby permit said retaining member to be moved from the second position into the first position, thus allowing said power cord to be removed from said power jack.

2. The cord retainer of claim 1, wherein said retaining member has a first serrated surface.

3. The cord retainer of claim 1, wherein said surface of said release housing portion has a second serrated surface.

4. The cord retainer of claim 1, wherein said retaining member has a first serrated surface and said surface of said release housing portion has a second serrated surface, and wherein said first serrated surface engages said second serrated surface for locking said retaining member in said second position.

5. The cord retainer of claim 4, wherein said second serrated surface of said release housing portion is biased against said first serrated surface of said retaining member by a biasing member.

6. The cord retainer of claim 5, wherein said biasing member comprises a spring.

7. The cord retainer of claim 1, wherein said retaining member comprises a button that protrudes through an opening in the release housing portion.

8. A power tool with a power cord retaining device for retaining a power cord to a power cord receptacle of the tool, the power tool comprising:

a power tool housing comprising an electrical power jack and having a first surface;

a retaining member disposed partially within the power tool housing and having one end pivotally supported within said power tool housing, said one end having a second surface, said retaining member being adapted to hold a plug of a power cord to said power jack when said retaining member is in a retracted position and to allow said plug to be removed from said power jack when said retaining member is moved into an open position;

a release button attached to said retaining member;

a biasing member for biasing the second surface of the retaining member into contact with the first surface within the power tool housing, said retaining member being moveable rotationally in a first direction to said retracted position when said first and second surfaces are in contact but not movable in a second direction toward said open position when said surfaces are in contact;

said release button being accessible by a user and manually engageable to urge said first and second surfaces apart from one another, to thereby enable said retaining member to be moved freely into said open position to allow said plug to be removed from said power jack.

9. The power tool of claim 8, wherein said first surface comprises a serrated surface.

10. The power tool of claim 8, wherein said second surface of said retaining member comprises a serrated surface.

11. The power tool of claim 8, wherein the retaining member has a first serrated surface and said first internal surface has a second serrated surface; and wherein said first serrated surface engages said second serrated surface for locking said retaining member in said plug engaging position.

12. A method for securing a power cord plug to an AC power jack of a power tool comprising the steps of:

providing a housing of the power tool comprising a power cord retaining member having a release button, said retaining member being adapted to engage said power cord plug and to hold said plug engaged to said AC power jack;

using a biasing member to bias a portion of said retaining member into engagement with a portion of the housing of the power tool, wherein said retaining member is moveable in a first direction into a plug engaging position but not in a second direction opposite to said direction toward a release position away from said AC power jack;

engaging the release button to urge said portion of said retaining member out of engagement with said portion of said housing, thereby enabling said retaining member to be urged into said release position;

while holding the release button engaged, rotationally moving the retaining member in said second direction to said release position to permit said power cord plug to be inserted into said AC power jack;

connecting said power cord plug to said AC power jack;

releasing said release button; and urging said retaining member in said first direction into said plug engaging position to thereby hold said power cord plug engaged in said AC power jack, said retaining member being prevented from moving in said second direction unless said release button is engaged.

* * * * *